US006342760B1

(12) United States Patent
Mashimo et al.

(10) Patent No.: US 6,342,760 B1
(45) Date of Patent: Jan. 29, 2002

(54) COLOR CATHODE RAY TUBE HAVING REINFORCING BAND ARRANGED IN A PARTICULAR POSITION RELATIVE TO THE POSITION OF STUD PIN

(75) Inventors: Takuya Mashimo; Norio Shimizu; Shinichiro Nakagawa, all of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/268,653

(22) Filed: Mar. 16, 1999

(30) Foreign Application Priority Data

Mar. 17, 1998 (JP) ..... 10-066950
Feb. 22, 1999 (JP) ..... 11-042859

(51) Int. Cl.[7] ..... H01J 31/12; H01J 29/82
(52) U.S. Cl. ..... 313/477 R; 313/402; 220/2.1
(58) Field of Search ..... 313/477 R, 479, 313/402, 461; 348/821, 822; 315/85; 220/2.1 A, 2.3 A, 407, 404; 445/8

(56) References Cited

U.S. PATENT DOCUMENTS 5,532,545 A * 7/1996 Okamoto et al. ..... 313/407
5,743,778 A * 4/1998 Arimoto et al. ..... 445/8
5,959,399 A * 9/1999 Arimoto et al. ..... 313/461
6,016,028 A * 1/2000 Iguchi et al. ..... 313/402
6,066,914 A * 5/2000 Shimizu et al. ..... 313/477 R

FOREIGN PATENT DOCUMENTS

JP 6-96697 4/1994

* cited by examiner

*Primary Examiner*—Vip Patel
*Assistant Examiner*—Karabi Guharay
(74) *Attorney, Agent, or Firm*—Oblon, Spivak, McClelland, Maier & Neustadt, P.C.

(57) ABSTRACT

A color cathode ray tube having a reinforcing band, which constricts the outer periphery of a skirt portion of a vacuum envelope, arranged so as to fulfill a relation, b≧2.0a, where a is the distance between first and second planes along a tube axis, the first plane intersecting an end edge of the skirt portion and extending perpendicular to the tube axis, the second plane containing the central axis of stud pins supporting a shadow mask and extending perpendicular to the tube axis, and b is the distance between the first plane and a third plane along the tube axis, the third plane intersecting a side edge of the reinforcing band facing a vacuum envelope funnel.

4 Claims, 2 Drawing Sheets

COLOR CATHODE RAY TUBE HAVING REINFORCING BAND ARRANGED IN A PARTICULAR POSITION RELATIVE TO THE POSITION OF STUD PIN

BACKGROUND OF THE INVENTION

The present invention relates to a color cathode ray tube provided with a reinforcing band for preventing implosion of a vacuum envelope.

In general, a color cathode ray tube is provided with a vacuum envelope of glass. The vacuum envelope comprises a substantially rectangular panel, which includes an effective portion and a skirt portion provided on the peripheral portion of an effective portion, and a funnel attached to an end face of the skirt portion as a sealed edge. A phosphor screen is formed on the inner surface of the effective portion of the panel. The screen is composed of three color phosphor layers that glow blue, green, and red, individually.

A substantially rectangular shadow mask is opposed to the inside of the phosphor screen. The shadow mask includes a substantially rectangular mask body and a substantially rectangular mask frame attached to the peripheral portion of the mask body. A large number of electron beam passage apertures are formed in an effective surface of the mask body that faces the phosphor screen. The shadow mask is supported by means of a mask supporting mechanism, which has stud pins and elastic support members. The stud pins are provided the skirt portion of the panel. The support members are fixed to the mask frame and engage their corresponding stud pins.

An electron gun for emitting three electron beams is disposed in a neck of the funnel. In the color cathode ray tube, the three electron beams emitted from the electron gun are deflected by means of a deflector, that is mounted on the outer surface of the funnel, so as to horizontally and vertically scan the phosphor screen through the shadow mask, thereby displaying a color image.

A reinforcing band is attached to the outer periphery of the skirt portion of the panel. The band constricts the skirt portion to apply compressive stress to it, in order to prevent implosion of the vacuum envelope. A practical example of the reinforcing band is of a shrunk-on type in which a previously looped band is expanded by heating and attached to the periphery of a skirt portion of a panel, and thereafter, the outer periphery of the skirt portion is shrunk to be constricted by cooling. Another example is of a type such that a belt-shaped band is wound around the outer periphery of a skirt portion of a panel and expanded by heating. Thereafter, in this case, the band is looped by welding its lap portions under tensile stress, and the skirt portion is shrunk to be constricted by cooling.

In the conventional color cathode ray tube, moreover, the reinforcing band is situated so as to overlap or externally surround the stud pins that support the shadow mask.

If the reinforcing band is located in this manner, however, the compressive stress that acts on the skirt portion of the panel varies depending on the circumferential position of the skirt portion. In particular, the compressive stress that acts in the diagonal direction of the panel at each corner of the skirt portion increases and indirectly influences the shadow mask that is supported inside the panel.

Usually, the outer peripheral length of the skirt portion of the panel and the inner peripheral length of the reinforcing band are subject to manufacturing errors, and temperature conditions for the thermal expansion of the band are subject to variations. Accordingly, the compressive stress from the reinforcing band that acts on each corner of the skirt portion in the diagonal direction of the panel fluctuates, so that beam landing on the three color phosphor layers is subject to variations.

In general, a color cathode ray tube that is fitted with the reinforcing band is attached to the housing of a TV set by means of lugs that are provided on the band. If the reinforcing band is situated overlapping the stud pins that support the shadow mask, therefore, voice vibrations from a loudspeaker of the TV set are transmitted to the shadow mask through the reinforcing band, stud pins, and elastic support members in engagement with the pins. The resulting resonance (microphonic vibration) of the shadow mask causes image disturbance.

In a color cathode ray tube that is provided with a flat panel having a flat or slightly curved effective portion, on the other hand, the curvature of the shadow mask is reduced corresponding to the effective portion, so that the strength of the mask is lowered. If only a small external force acts on the tube, therefore, the shadow mask is influenced considerably. Thus, the aforementioned problems are more serious to the color cathode ray tube of this type than to the conventional one.

BRIEF SUMMARY OF THE INVENTION

The present invention has been contrived in consideration of these circumstances, and its object is to provide a color cathode ray tube, in which variations in beam landing attributable to variations in the compressive stress of a reinforcing band and image disturbance caused by resonance of a shadow mask can be reduced.

In order to achieve the above object, a color cathode ray tube according to the present invention comprises: a vacuum envelope having a panel, including a substantially rectangular effective portion and a skirt portion provided on the peripheral portion of the effective portion, and a funnel joined to an end edge of the skirt portion; a shadow mask including a substantially rectangular mask body and a substantially rectangular mask frame attached to the peripheral portion of the mask body, the mask body having an effective surface opposed to a phosphor screen on the inner surface of the effective portion and a large number of electron beam passage apertures formed in the effective surface; a mask supporting mechanism supporting the shadow mask and including stud pins arranged on the skirt portion and elastic support members fixed to the mask frame and engaging the stud pins, individually; and a reinforcing band constricting the outer periphery of the skirt portion.

The reinforcing band is arranged so as to fulfill a relation, $b \geqq 2.0a$, where a is the distance between first and second planes along a tube axis passing through the center of the effective portion of the panel, the first plane being in contact with the end edge of the skirt portion and extending perpendicular to the tube axis, the second plane containing the central axis of each of the stud pins and extending perpendicular to the tube axis, and b is the distance between the first plane and a third plane along the tube axis, the third plane being in contact with a side edge of the reinforcing band on the side remoter from the phosphor screen and extending perpendicular to the tube axis.

If the position of the reinforcing band relative to each stud pin is regulated in this manner, the reinforcing band, which constricts the skirt portion of the panel, never overlaps the stud pins that support the shadow mask, so that it never directly constricts those portions on which the stud pins are arranged. Accordingly, the shadow mask can be less influenced by compressive stress that acts on the skirt portion as the skirt portion is constricted by the reinforcing band. Thus, deviations in beam landing, which is attributable to variations in the compressive stress, can be lessened.

In the case where the color cathode ray tube is incorporated in a TV set, moreover, voice vibrations transmitted from a loudspeaker to the shadow mask can be attenuated to lower the possibility of resonance of the mask. Since no substantial load from the reinforcing band acts on those portions of the panel which are lowered in strength due to the presence of the stud pins, furthermore, the implosion-proof characteristic of the vacuum envelope can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 show a color cathode ray tube according to an embodiment of the present invention, in which:

FIG. 1 is a plan view, partially in section, showing the color cathode ray tube;

FIG. 2 is a sectional view of a panel of the color cathode ray tube taken along line II—II of FIG. 1; and FIG. 3 is a sectional view showing the relative positions of a reinforcing band and a mask supporting mechanism.

DETAILED DESCRIPTION OF THE INVENTION

A color cathode ray tube according to an embodiment of the present invention will now be described in detail with reference to the accompanying drawings.

Figure 1:
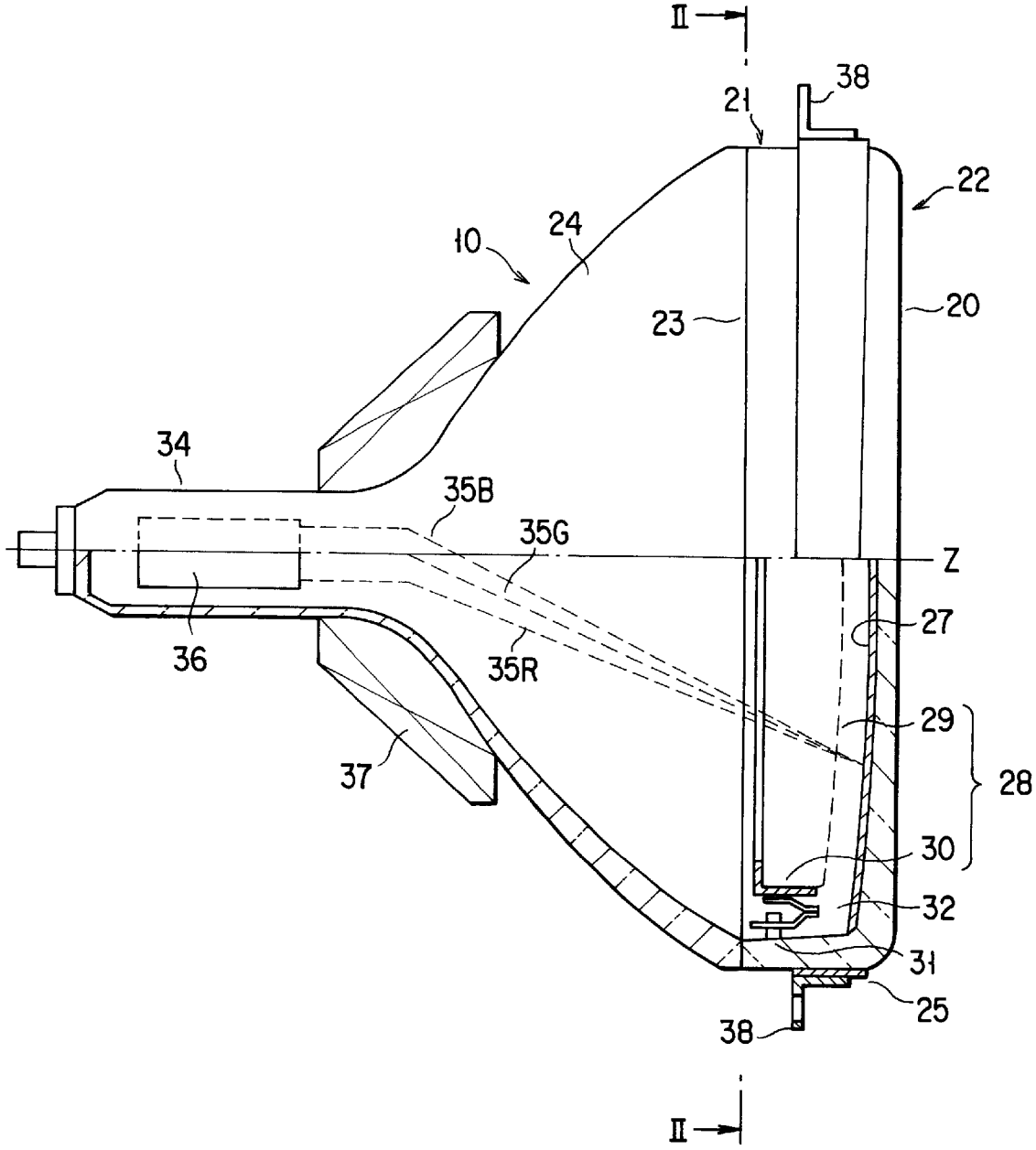
Figure 2:
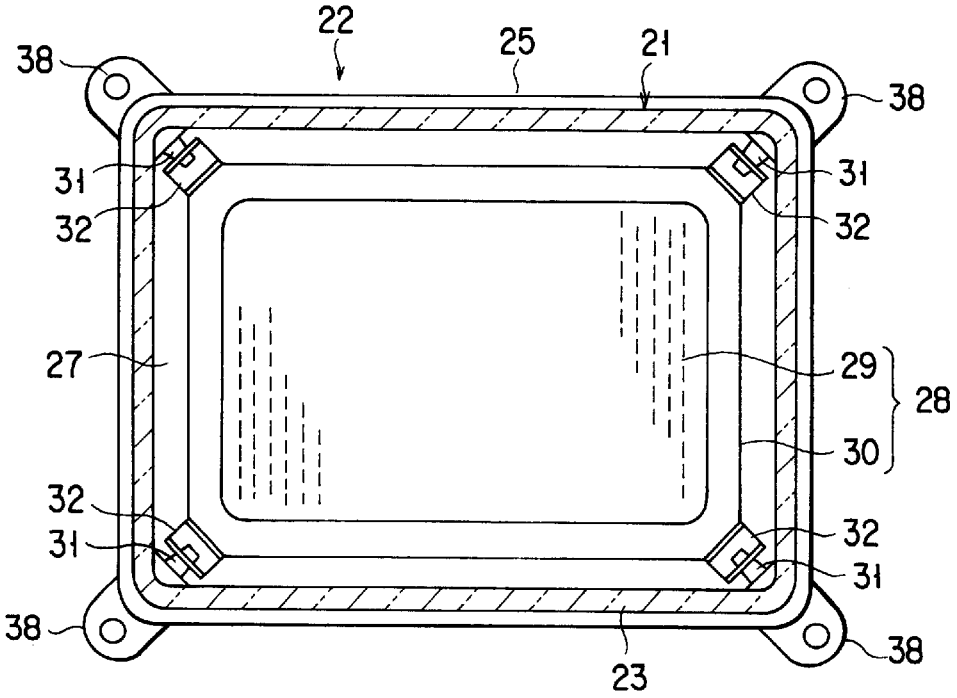

As shown in FIGS. 1 and 2, the color cathode ray tube comprises a vacuum envelope 10 of glass. The vacuum envelope 10 comprises a substantially rectangular panel, which includes a substantially rectangular effective portion 20 and a skirt portion 21 provided on the peripheral portion of the effective portion, and a funnel 24 joined to an end face 23 of the skirt portion as a sealed edge. The effective portion 20 is substantially flat, and its outer surface is composed of a flat surface or a curved surface that has a radius of curvature of 10,000 mm or more.

A phosphor screen 27 is formed on the inner surface of the effective portion 20 of the panel 22. The screen 27 includes three color phosphor layers that glow blue, green, and red, individually. A substantially rectangular shadow mask 28 is opposed to the inside of the screen 27. The shadow mask 28 includes a substantially rectangular mask body 29 and a substantially rectangular mask frame 30 attached to the peripheral portion of the mask body. A large number of electron beam passage apertures are formed in an effective surface of the mask body 29 that faces the phosphor screen 27.

Figure 3:
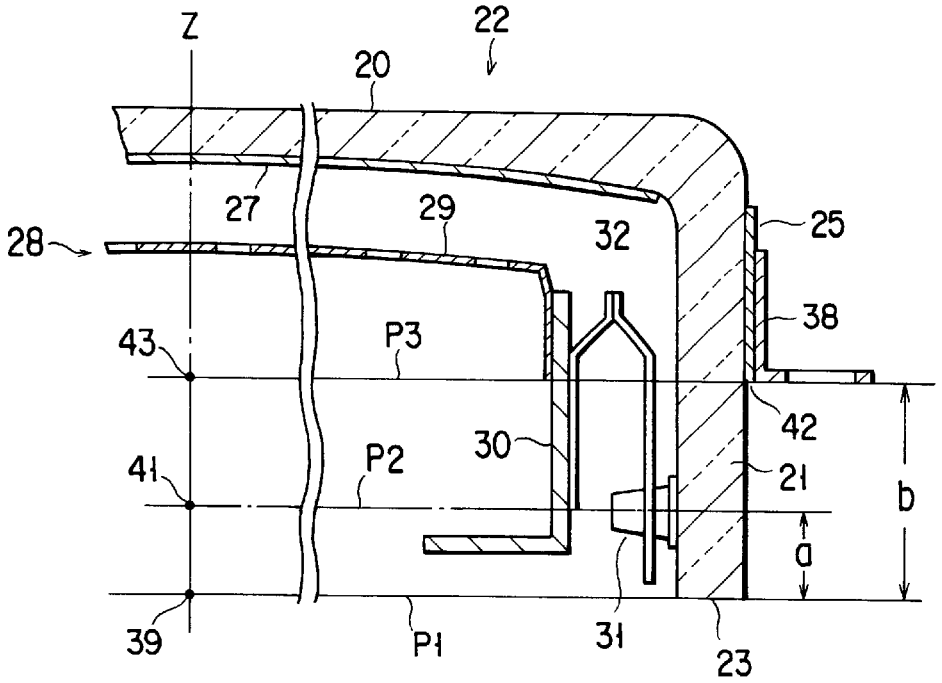

As shown in FIGS. 1 to 3, the shadow mask 28 is supported on the inside of the panel 22 by means of a mask supporting mechanism. The supporting mechanism includes stud pins 31 and elastic support members 32. The stud pins 31 are arranged individually at the four corners of the skirt portion 21 of the panel 22. The support members 32 are fixed individually to the four corners of the outer surface of the mask frame 30 and engage their corresponding stud pins 31.

As shown in FIG. 1, a neck 34 is joined to the small-diameter-side end of the funnel 24, and an electron gun 36 for emitting three electron beams 35R, 35B and 35G is disposed in the neck. The gun 36 is located substantially coaxially with a tube axis Z that passes through the center of the effective portion 20 of the panel 22.

In the color cathode ray tube, the three electron beams 35R, 35B and 35B are deflected by a magnetic field generated from a deflector 37 that is attached to the outside of the funnel 24. In this state, a color image is displayed as the phosphor screen 27 is scanned horizontally and vertically through the shadow mask 28.

As shown in FIGS. 1 to 3, a reinforcing band 25 is attached to the outer periphery of the skirt portion 21 of the panel 22. The band 25 constricts the skirt portion 21 to apply compressive stress to it, in order to prevent implosion of the vacuum envelope 10. The reinforcing band 25, which is a rectangular structure substantially coaxial with the tube axis Z, extends throughout the circumference of the skirt portion 21. Further, lugs 38 are fixed to the respective outer surfaces of the four corners of the band 25, individually. The color cathode ray tube is attached to the housing of a TV set by means of the lugs 38.

In this color cathode ray tube, the reinforcing band 25 on the outer periphery of the skirt portion 21 is situated in a position shifted from the stud pins 31 toward the phosphor screen 27 along the tube axis Z lest it overlap the pins 31.

More specifically, as shown in FIG. 3, the reinforcing band 25 is provided on the outer periphery of the skirt portion 21 of the panel 22 so as to fulfill the following relation:

$$b \geqq 2.0a,$$

where a is the distance from a point 39 at which a first plane P1, which is in contact with the end face 23 of the skirt portion 21 and extends perpendicular to the tube axis Z, crosses the axis Z to a point 41 at which a second plane P2, which contains the central axis of each stud pin 31 and extends perpendicular to the tube axis Z, crosses the axis Z, that is, the distance between the first and second planes P1 and P2 along the axis Z, and b is the distance from a point 43 at which a third plane P3, which is in contact with a side edge 42 of the reinforcing band 25 on the side (sealed-edge side) remoter from the phosphor screen 27 and extends perpendicular to the tube axis Z, crosses the axis Z to the point 39, that is, the distance between the first and third planes P1 and P3 along the axis Z.

The table below shows the results of a test on the landing characteristic (landing stability) of electron beams and microphonic vibration characteristic of the shadow mask 28, for three color cathode ray tubes with an aspect ratio of 16:9 and screen diagonal sizes of 66 cm, 76 cm, and 86 cm and a color picture tube with an aspect ratio of 4:3 and a screen diagonal size of 68 cm. In this test, the distances a and b were set at various values. In the table, ⊙, ○, and Δ indicate the priority order of adequacy of the characteristics.

TABLE

| Aspect ratio | Diagonal size (cm) | a (mm) | b (mm) | Relational expression | Landing stability | Microphonic vibration |
|---|---|---|---|---|---|---|
| 16:9 | 66 | 20.0 | 40 | b = 2.0a | Δ | Δ |
| | 76 | 21.5 | 43 | b = 2.0a | Δ | Δ |
| | 86 | 20.0 | 47 | b = 2.35a | ○ | ○ |
| 4:3 | 68 | 21.5 | 57 | b = 2.65a | ○ | ◎ |

As seen from this table, the longer the distance (a–b) from each stud pin 31 to the opposite side edge 42 of the reinforcing band 25, the higher the landing stability of the electron beams is. The longer the distance (a–b), moreover, the more difficult it is for microphonic vibration to occur. Very good results were obtained from the color cathode ray tube with the diagonal size of 68 cm.

The landing and microphonic vibration characteristics can be improved by adjusting the relative positions of each stud pin 31 and the opposite side edge 42 of the reinforcing band 25 so that the distance b is $b \geqq 2.0a$, and preferably to $b \geqq 2.3a$, without regard to the size of the color cathode ray tube. If the position of the reinforcing band 25 relative to each stud pin 31 is regulated in this manner, the band 25, which constricts the skirt portion 21 of the panel 22, never overlaps the stud pins 31 that support the shadow mask 28, so that it never directly constricts those portions on which the pins 31 are arranged. Accordingly, the shadow mask 28 can be less influenced by the compressive stress that acts on the skirt portion 21 as the skirt portion is constricted by the reinforcing band 25. Thus, if the compressive stress from the band 25 is subject to some variations, depending on the position of the skirt portion 21 or owing to manufacturing errors in the outer peripheral length of the skirt portion 21, the inner peripheral length of the band 25, etc., the influence of the variations in the compressive stress upon the shadow mask 28 is reduced, so that deviations in beam landing can be lessened.

In the case where the color cathode ray tube is incorporated in the TV set, moreover, voice vibrations transmitted from a loudspeaker to the shadow mask 28 can be attenuated to lower the possibility of resonance of the mask 28 for the same reason as aforesaid. Since no substantial load from the reinforcing band acts on those portions of the panel 22 which are lowered in strength due to the presence of the stud pins 31, furthermore, the implosion-proof characteristic of the vacuum envelope can be improved.

It is to be understood that the present invention is not limited to the embodiment described above, and that various changes and modifications may be effected therein by one skilled in the art without departing from the scope or spirit of the invention. According to the above-described embodiment, for example, the supporting mechanism for the shadow mask has the stud pins arranged individually at the corners of the skirt portion and the elastic support members fixed individually to the corners of the mask frame. However, the present invention is also applicable to a color cathode ray tube in which a shadow mask is supported by means of stud pins arranged individually on the respective intermediate portions of the four sides of a substantially rectangular skirt portion and elastic support means fixed individually to the respective intermediate portions of the four sides of a substantially rectangular mask frame.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

a vacuum envelope having a panel, including a substantially rectangular effective portion and a skirt portion provided on the peripheral portion of the effective portion, and a funnel joined to an end edge of the skirt portion;

a shadow mask including a substantially rectangular mask body and a substantially rectangular mask frame attached to the peripheral portion of the mask body, the mask body having an effective surface opposed to a phosphor screen formed on an inner surface of the effective portion and a large number of electron beam passage apertures formed in the effective surface;

a mask supporting mechanism supporting the shadow mask and including stud pins arranged on the skirt portion and elastic support members fixed to the mask frame and engaging respective of the stud pins; and a reinforcing band constricting the outer periphery of the skirt portion and having a sealed edge side facing the funnel and an opposite side facing the effective portion of the panel, the reinforcing band being arranged so as to fulfill a relation, $b \geqq 2.0a$, where a is the distance between first and second planes along a tube axis passing through a center of the effective portion of the panel, the first plane intersecting the end edge of the skirt portion and extending perpendicular to the tube axis, the second plane containing a central axis of each stud pin and extending perpendicular to the tube axis, and b is the distance between the first plane and a third plane along the tube axis, the third plane intersecting the sealed edge side of the reinforcing band.

2. A color cathode ray tube according to claim 1, wherein the stud pins are arranged individually inside the corners of the skirt portion, and the elastic support members are arranged individually at the corners of the mask frame.

3. A color cathode ray tube according to claim 1, wherein the effective portion of the panel includes a flat or curved outer surface having a radius of curvature of 10,000 mm or more.

4. A color cathode ray tube according to claim 1, wherein the reinforcing band is arranged so as to fulfill a relation, $b \geqq 2.3a$.

* * * * *